US007172459B2

(12) United States Patent
Hayashi et al.

(10) Patent No.: US 7,172,459 B2
(45) Date of Patent: Feb. 6, 2007

(54) ELECTRICAL CONNECTOR HOUSING, ELECTRICAL CONNECTOR, AND CONNECTOR ASSEMBLY

(75) Inventors: Toshiaki Hayashi, Aichi (JP); Atsushi Nishida, Aichi (JP)

(73) Assignee: Tyco Electronics Amp K.K., Kanagawa-ken (JP)

( * ) Notice: Subject to any disclaimer, the term of this patent is extended or adjusted under 35 U.S.C. 154(b) by 0 days.

(21) Appl. No.: 11/289,718

(22) Filed: Nov. 29, 2005

(65) Prior Publication Data

US 2006/0116017 A1 Jun. 1, 2006

(30) Foreign Application Priority Data

Nov. 30, 2004 (JP) ..... 2004-346273

(51) Int. Cl.
*H01R 13/40* (2006.01)

(52) U.S. Cl. ..... 439/598; 439/903; 439/489

(58) Field of Classification Search ..... 439/598, 439/701, 731, 686, 488, 595, 903, 357
See application file for complete search history.

(56) References Cited

U.S. PATENT DOCUMENTS 6,062,892 A * 5/2000 Meng et al. ..... 439/357
2001/0016444 A1* 8/2001 Fenger ..... 439/358

FOREIGN PATENT DOCUMENTS

| | | |
|---|---|---|
| JP | 09-251876 | 9/1997 |
| JP | 2002-231372 | 8/2002 |
| JP | 2003-331989 | 11/2003 |

* cited by examiner

*Primary Examiner*—Javaid H. Nasri
(74) *Attorney, Agent, or Firm*—Barley Snyder LLC

(57) ABSTRACT

A split electrical connector housing comprises a first housing and a second housing independent from the first housing. The first housing has a plurality of contact receiving compartments and a projection extending from an outer surface thereof. The second housing has a first housing receiving opening that receives the first housing. An elastic arm is formed on an outer surface of the second housing. The elastic arm has a protrusion that extends into the first housing receiving opening and engages the projection as the first housing is received in the first housing receiving opening. The elastic arm is biased upward by the projection to change a contour of the outer surface of the second housing when the first housing is partially received in the second housing.

22 Claims, 9 Drawing Sheets

ELECTRICAL CONNECTOR HOUSING, ELECTRICAL CONNECTOR, AND CONNECTOR ASSEMBLY

FIELD OF THE INVENTION

The invention relates to an electrical connector having a split electrical connector housing and a connector assembly comprising the same.

BACKGROUND OF THE INVENTION

Traditionally, electrical connectors having a split electrical connector housing comprise a first housing independent from a second housing. The split electrical connector housing creates a connection between mated connectors for a wire harness in use in an automobile and the like. As more sensors are being installed in automobiles, the number of electrical connectors needed for wire harnesses also increases. Consequently, a greater number of electrical connectors must be mated with their counterparts in an automobile assembly line, which results in lower productivity.

Japanese Patent Application Publication No. 2003-331989 discloses a technique to prevent incorrect connection between the first and second housings of the electrical connector. In Japanese Patent Application Publication No. 2002-231372 the electrical connector has a common second housing that can receive different types of first housings. However, when one or more of the first housings are accommodated in the second housing in a different assembly line, partially inserted first housings can still pass a continuity test. Because the first housings are not fully inserted, the connection can become further disengaged due to later occurring vibrations.

Various techniques have been proposed to detect partial insertion of an electrical connector in a mating connector. For example, Japanese Patent Application Publication No. 9-251876 discloses a structure wherein contacts provided in a housing of each of the connectors are not connected to their counterpart until the connectors are fully mated with each other. When the contacts are connected, an electric circuit is actuated to detect complete mating of the connectors. While it is possible to employ such a technique to the first housing and the second housing of an electrical connector having a split electrical connector housing, the installation of a detecting circuit would unduly complicate the configuration of the electrical connector.

BRIEF SUMMARY OF THE INVENTION

It is therefore an object of the invention to provide an electrical connector having a split electrical connector housing. The split electrical connector housing comprises a first housing and a second housing independent from the first housing. The first housing has a plurality of contact receiving compartments and a projection extending from an outer surface thereof. The second housing has a first housing receiving opening that receives the first housing. An elastic arm is formed on an outer surface of the second housing. The elastic arm has a protrusion that extends into the first housing receiving opening and engages the projection as the first housing is received in the first housing receiving opening. The elastic arm is biased upward by the projection to change a contour of the outer surface of the second housing when the first housing is partially received in the second housing.

It is further an object of the invention to provide an electrical connector assembly comprising a mating connector and an electrical connector. The mating connector has a housing with a connector engaging section and an edge adjacent to the connector engaging section. The electrical connector has with a split connector housing that is received in the connector engaging section. The split connector housing includes a first housing and a second housing independent from the first housing. The first housing has a plurality of contact receiving compartments and a projection extending from an outer surface thereof. The second housing has a first housing receiving opening that receives the first housing. An elastic arm is formed on an outer surface of the second housing. The elastic arm has a protrusion that extends into the first housing receiving opening and engages the projection as the first housing is received in the first housing receiving opening. The elastic arm is biased upward by the projection and engages the edge of the mating connector when the first housing is partially received in the second housing.

DETAILED DESCRIPTION OF THE INVENTION

Figure 1:
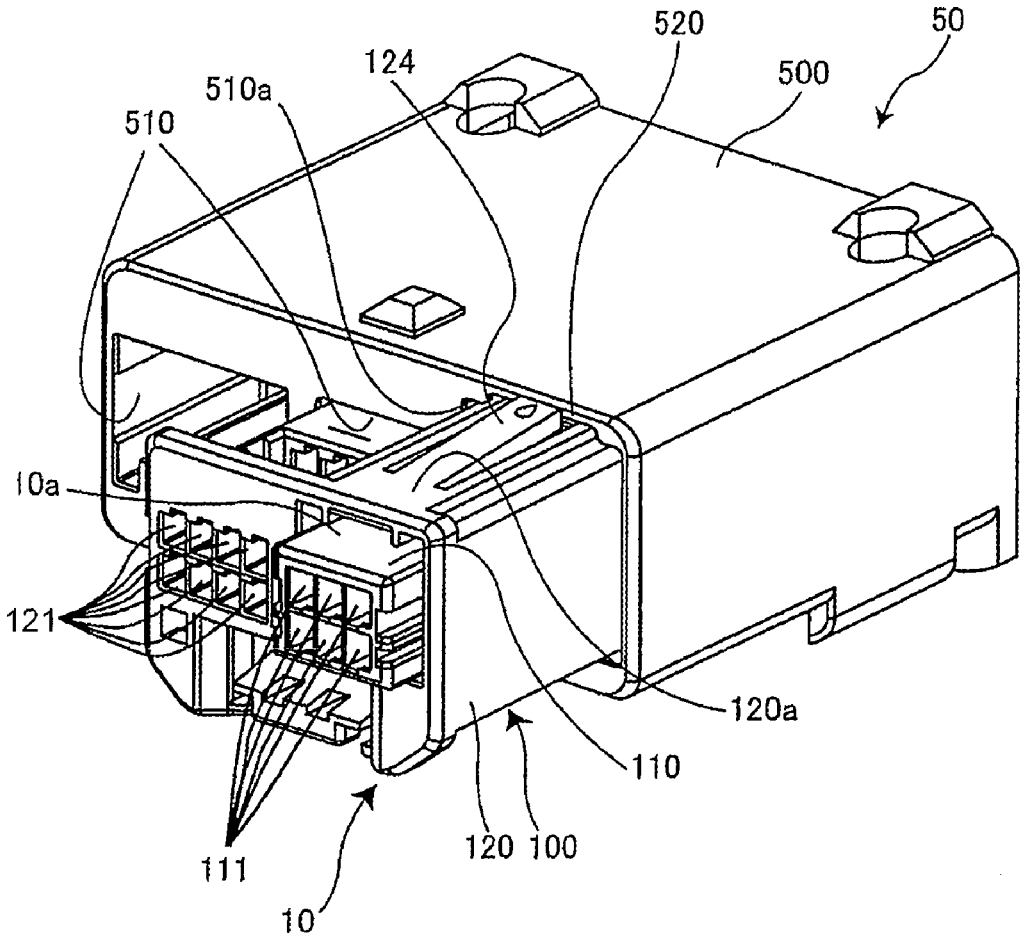
FIG. 1 is a perspective view of a connector assembly according to an embodiment of the invention.
Figure 2:
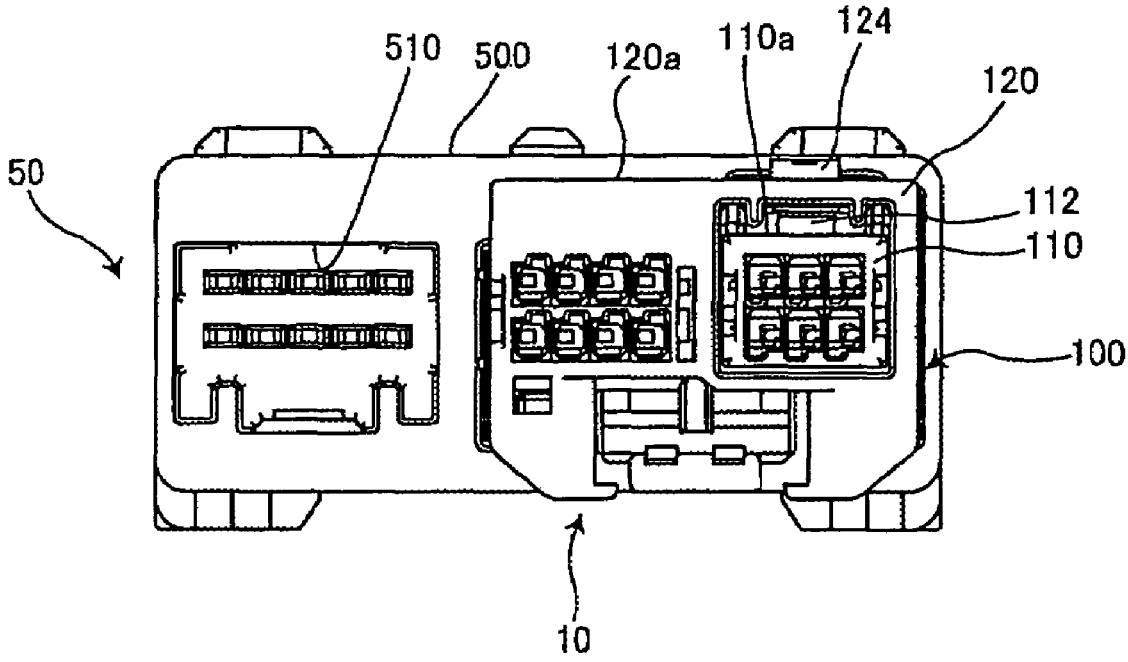
FIG. 2 is a front view of the connector assembly of FIG. 1 showing an electrical connector partially inserted into a mating connector with a first housing of the electrical connector partially inserted into a second housing of the electrical connector.
Figure 3:
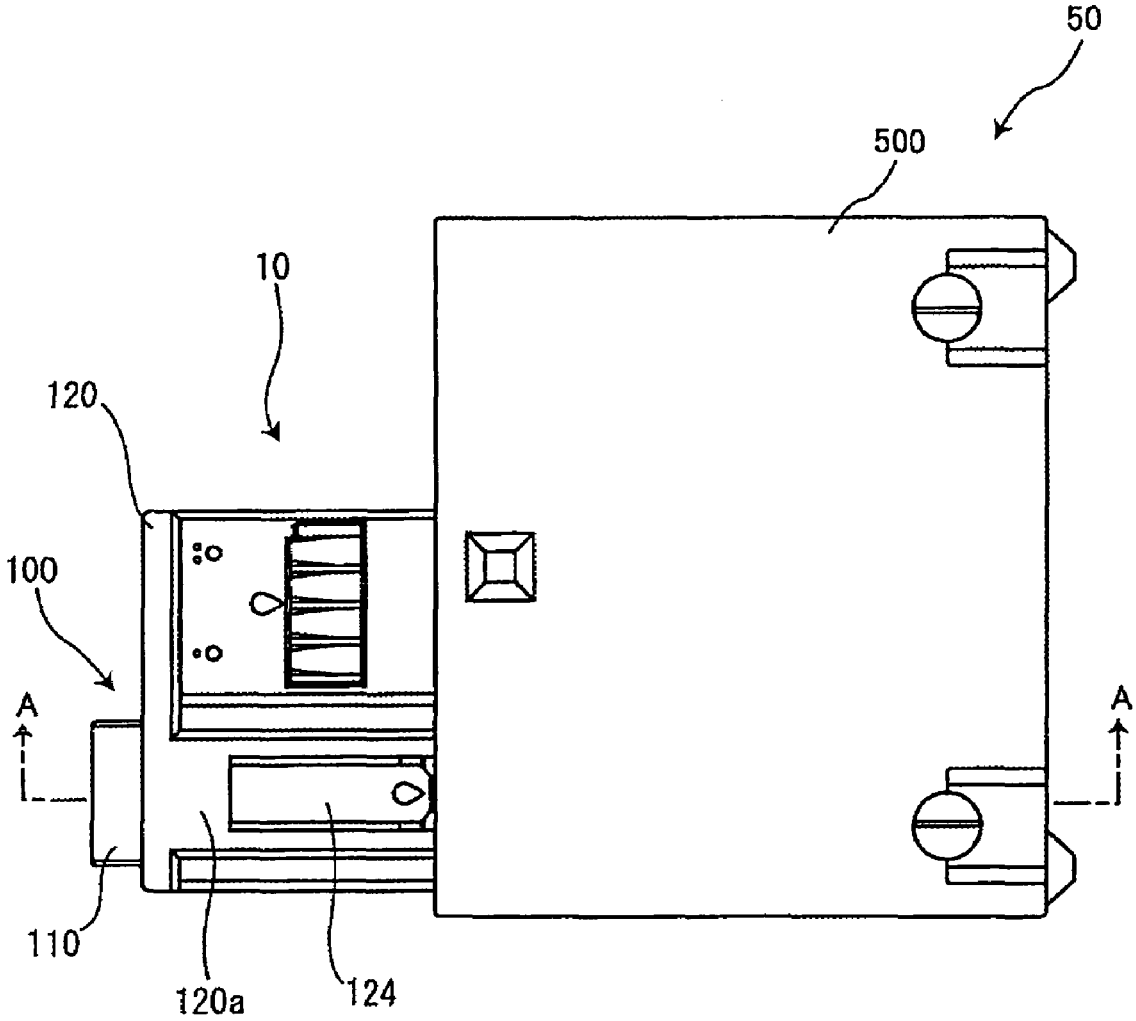
FIG. 3 is a top view of FIG. 2.
Figure 4:
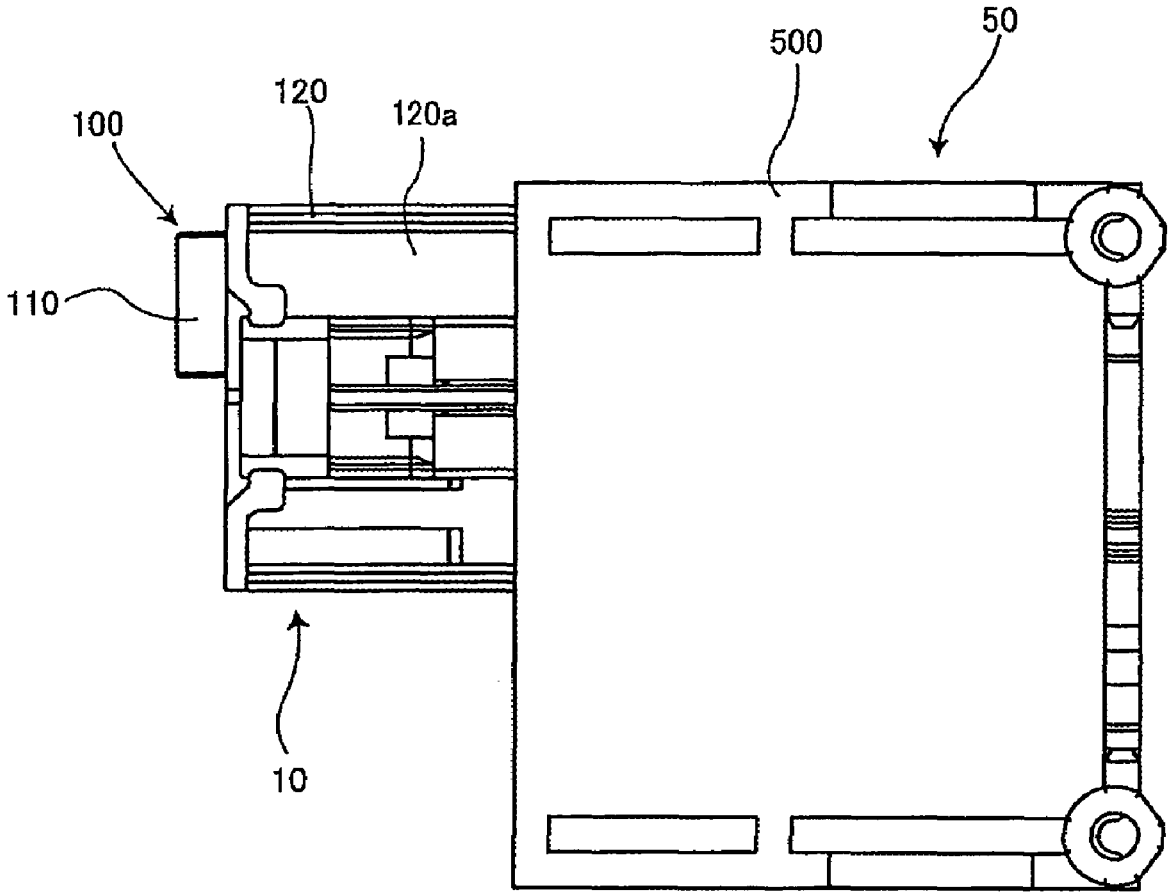
FIG. 4 is a bottom view of FIG. 2.
Figure 5:
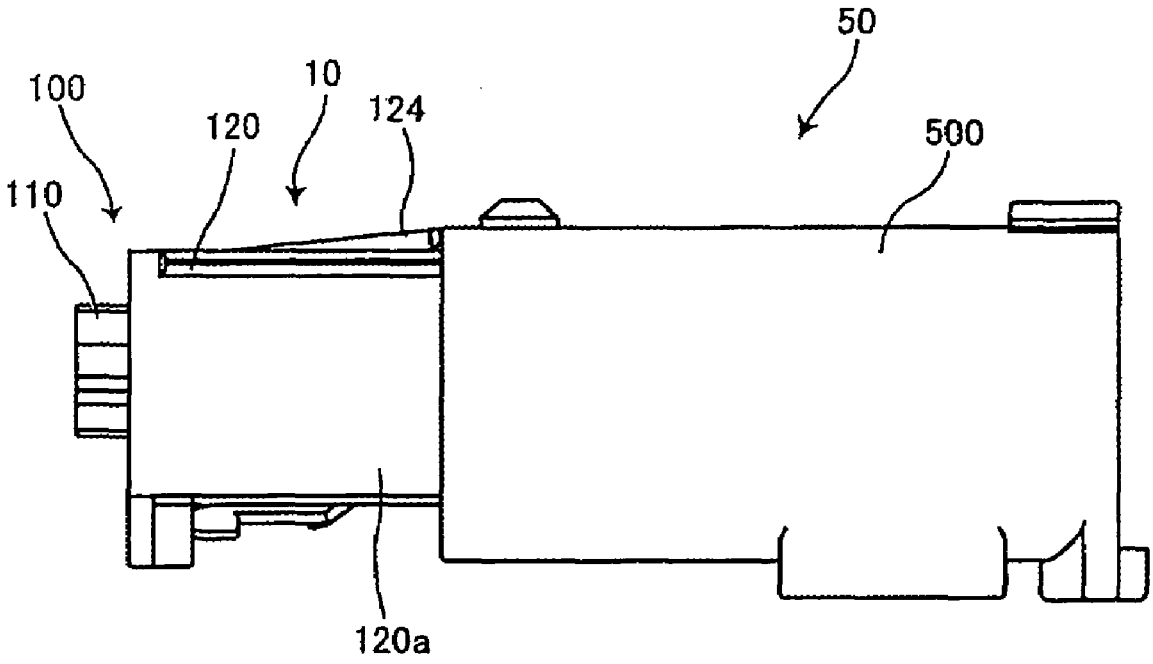
FIG. 5 is a side view of FIG. 2.
Figure 6:
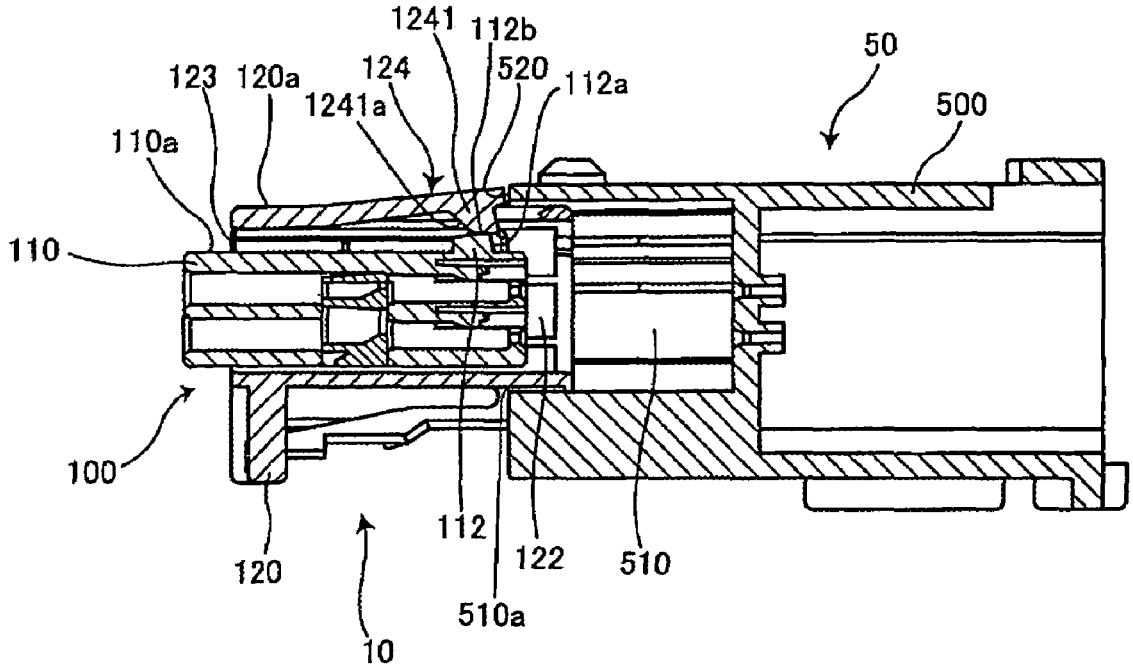
FIG. 6 is a sectional view taken along line A—A of FIG. 3.
Figure 9:
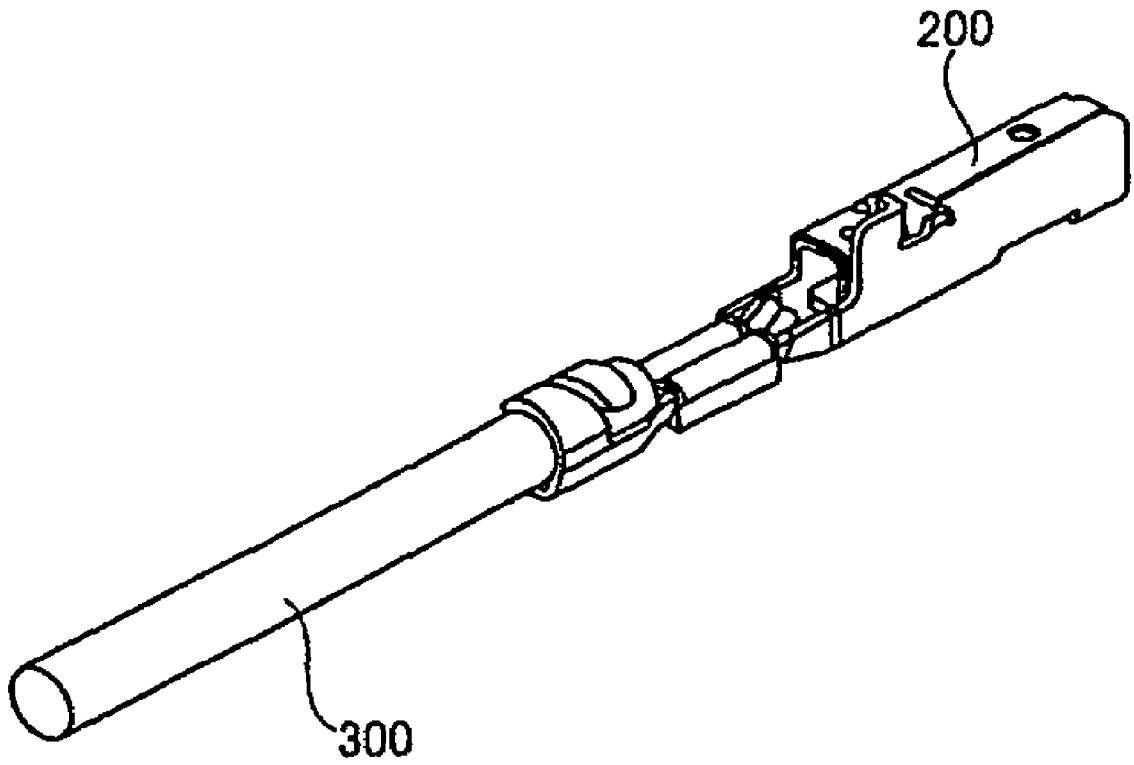
FIG. 9 is a perspective view of a contact.

Embodiments of the invention will be described below with reference to the attached drawings. FIG. 1 shows a connector assembly according to a first embodiment of the invention. The connector assembly comprises an electrical connector 10 and a mating connector 50. The electrical connector 10 includes a split electrical connector housing 100. The split electrical connector housing 100 consists of a first housing 110 formed independent from a second housing 120. The first housing 110 corresponds to a housing of an electrical connector for a wire harness and has a plurality of contact receiving compartments 111 that accommodate a plurality of contacts 200 with cables 300 extending therefrom (FIG. 9). As shown in FIGS. 2 and 6, a projection 112 extends outward from an outer surface 110*a* of the first housing 100. The projection 112 has an inclined front surface 112*a* and an inclined top surface 112*b*.

As shown in FIG. 6, the second housing 120 has a first section with a first housing receiving opening 123 and a second section that may be provided with a plurality of contact receiving compartments 121 that accommodate a plurality of contacts (not shown), as shown in FIG. 1. An empty space 122 that communicates with the first housing receiving opening 123 is formed inside the second housing 120. An elastic arm 124 is provided on an outer surface 120*a* of the second housing 120 and may be formed, for example, by cuts made on the outer surface 120*a*. A tip of the elastic arm 124 faces the first housing receiving opening 123 and has a protrusion 1241 that extends downward. The protrusion 1241 has an inclined rear surface 1241*a* that has a greater slope than the inclined front surface 112*a* of the projection 112.

As shown in FIG. 1, the mating connector 50 comprises a housing 500. The housing 500 has aligned connector engaging sections 510. One of the connector engaging sections 510 is formed to receive the electrical connector 10. An opening 510*a* communicates with the connector engaging section 510 that receives the electrical connector 10. The opening 510*a* has an edge 520. The mating connector 50 is provided with a plurality of contacts (not shown).

Figure 7:
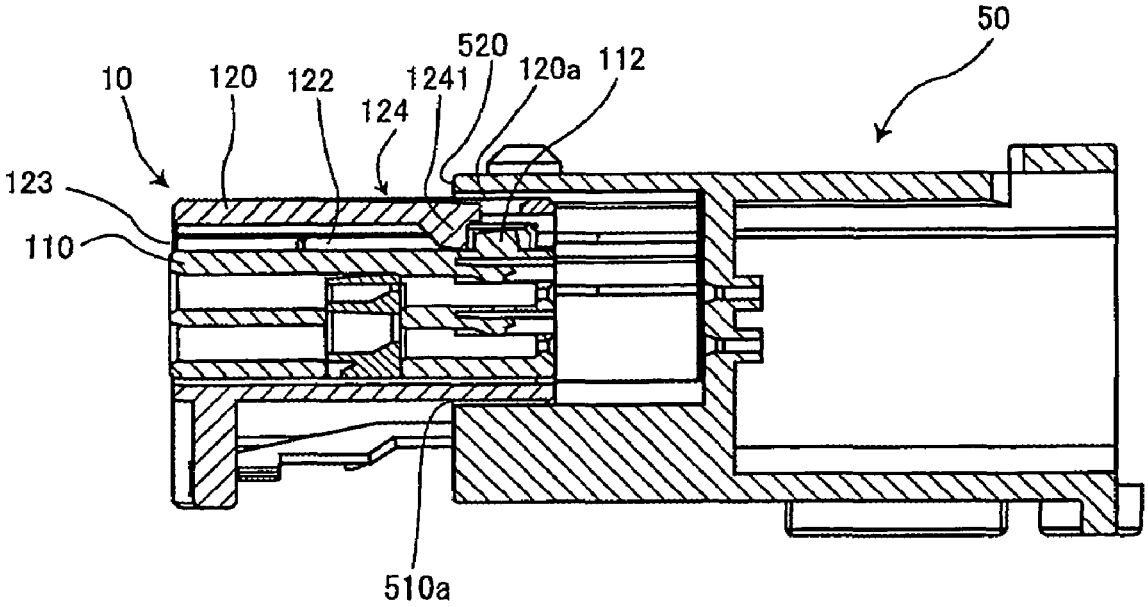
FIG. 7 is a sectional view showing the electrical connector partially inserted into the mating connector with the first housing of the electrical connector fully inserted into the second housing of the electrical connector.

FIG. 1 shows the first housing 110 partially inserted in the second housing 120. The first housing 110 is inserted into the opening 123 in the second housing 120. Specifically in FIG. 6, the first housing 110 is pushed from the right side to the left side of the figure. As the first housing 110 is inserted into the opening 123, the first housing 110 comes into abutment with the protrusion 1241 of the elastic arm 124 of the second housing 120. As the first housing 110 is further inserted, the projection 112 of the first housing 110 lifts the protrusion 1241 of the elastic arm 124 of the second housing 120 to an outside thereof. The inclined front surface 112*a* of the projection 112 of the first housing 110 lifts the protrusion 1241 of the elastic arm 124 prior to the first housing 110 being received in the empty space 122. As the first housing 110 is further inserted, the protrusion 1241 of the elastic arm 124 of the second housing 120, which is already lifted by the projection 112 of the first housing 110, slides over the top surface 112*b* of the projection 112. Since the top surface 112*b* is slanted downward toward the upstream of the pushing direction, the lifted elastic arm 124 descends gradually by its own elasticity as the first housing 110 is further inserted. The first housing 110 is inserted into the opening 123 in the second housing 120 until it reaches the empty space 122, as shown in FIG. 7.

In the electrical connector 10, the contour of the second housing 120 changes depending on whether the first housing 110 is fully received in the second housing 120. Because the elastic arm 124 of the second housing 120 is lifted by the projection 112 of the first housing 110 when the first housing 110 is not yet fully inserted into the second housing 120, if an operator tries to fit the electrical connector 10 into the connector engaging section 510 of the mating connector 50 before the first housing 110 is fully inserted into the second housing 120, the elastic arm 124 will engage the edge 520 of the opening 510*a* of the mating connector 50 thereby preventing insertion therein. Accordingly, it is possible for an operator to notice partial insertion of the first housing 110 in the second housing 120 during insertion of the electrical connector 10 into the mating connector 50.

Figure 8:
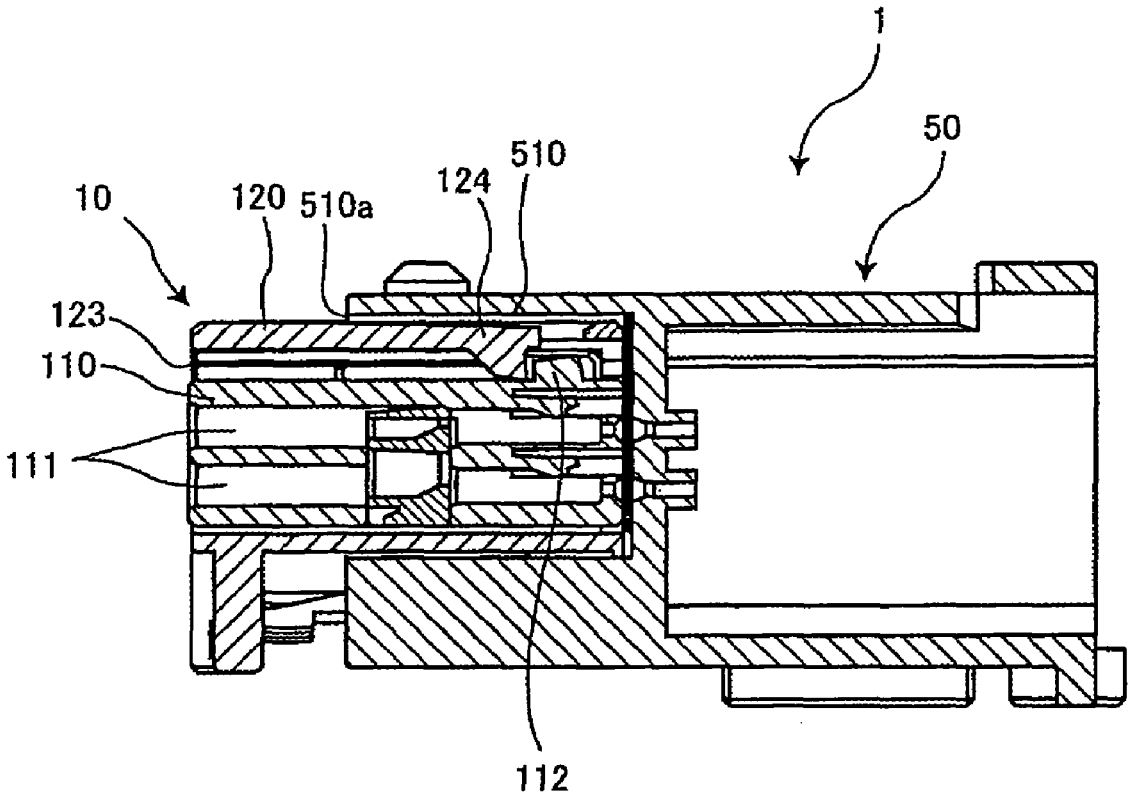
FIG. 8 is a sectional view showing the electrical connector fully inserted into the mating connector with the first housing of the electrical connector fully inserted into the second housing of the electrical connector.

When the projection 112 of the first housing 110 has passed the protrusion 1241 of the elastic arm 124, the elastic arm 124 descends gradually by its own elasticity to its original state so that the elastic arm 124 is released from the edge 520 of the opening 510*a* and can enter into the opening 123 of the second housing 120 so that the split electrical connector housing 100 of the electrical connector 10 and the housing 500 of the mating connector 50 can be fully mated, as shown in FIG. 8. In this position, an operator cannot forcibly pull the first housing 110 from the second housing 120, because the protrusion 1241 of the elastic arm 124 engages the projection 112 of the first housing 110 and locks the first housing 110 in position.

The foregoing illustrates some of the possibilities for practicing the invention. Many other embodiments are possible within the scope and spirit of the invention. For example, the elastic arm 124 may be integrally formed in the outer surface 120*a* of the second housing 120 or may be formed separately from the outer surface 120*a*. Additionally, the first housing 110 is not limited to use with a wire harness or with the type of contacts shown in FIG. 9. It is, therefore, intended that the foregoing description be regarded as illustrative rather than limiting, and that the scope of the invention is given by the appended claims together with their full range of equivalents.

What is claimed is:

1. An electrical connector having a split electrical connector housing, the split electrical connector housing comprising:

a first housing with a plurality of contact receiving compartments, the first housing having a projection extending from an outer surface thereof;

a second housing independent from the first housing, the second housing having a first housing receiving opening that receives the first housing; and an elastic arm formed on an outer surface of the second housing, the elastic arm extending on the outer surface of the second housing from a side formed for insertion of the first housing into the first housing receiving opening toward a side formed for receipt in a mating connector, the elastic arm having a protrusion that extends into the first housing receiving opening on the side of the second housing formed for receipt in the mating connector that engages the projection as the first housing is received in the first housing receiving opening, the elastic arm being biased upward by the projection to change a contour of the outer surface of the second housing when the first housing is partially received in the second housing.

2. The electrical connector of claim 1, wherein the second housing has a section separate from the first housing receiving opening provided with a plurality of contact receiving compartments.

3. The electrical connector of claim 1, wherein the projection has an inclined front surface and an inclined top surface for facilitating movement of the protrusion there over.

4. The electrical connector of claim 3, wherein the protrusion has an inclined rear surface that has a greater slope than the inclined front surface of the projection.

5. The electrical connector of claim 1, wherein the protrusion locks the first housing in the second housing when the first housing is fully received therein.

6. The electrical connector of claim 5, wherein the protrusion engages the projection to lock the first housing in the second housing.

7. The electrical connector of claim 1, wherein the contour of the outer surface of the second housing is restored when the first housing is fully received in the second housing.

8. The electrical connector of claim 1, wherein the second housing has a plurality of cuts that form the elastic arm.

9. An electrical connector assembly, comprising:

a mating connector with a housing having a connector engaging section and an edge adjacent to the connector engaging section; and an electrical connector with a split connector housing that is received in the connector engaging section, the split connector housing having a first housing with a plurality of contact receiving compartments, the first housing having a projection extending from an outer surface thereof, and a second housing independent from the first housing, the second housing having a first housing receiving opening that receives the first housing, an elastic arm being formed on an outer surface of the second housing, the elastic arm having a protrusion that extends into the first housing receiving opening and engages the projection as the first housing is received in the first housing receiving opening, the elastic arm being biased upward by the projection and engaging the edge of the mating connector when the first housing is partially received in the second housing.

10. The electrical connector assembly of claim 9, wherein the second housing has a section separate from the first housing receiving opening provided with a plurality of contact receiving compartments.

11. The electrical connector assembly of claim 9, wherein the projection has an inclined front surface and an inclined top surface for facilitating movement of the protrusion there over.

12. The electrical connector assembly of claim 11, wherein the protrusion has an inclined rear surface that has a greater slope than the inclined front surface of the projection.

13. The electrical connector assembly of claim 9, wherein the protrusion locks the first housing in the second housing when the first housing is fully received therein.

14. The electrical connector assembly of claim 13, wherein the protrusion engages the projection to lock the first housing in the second housing.

15. The electrical connector assembly of claim 9, wherein a contour of the outer surface of the second housing is restored when the first housing is fully received in the second housing.

16. The electrical connector assembly of claim 9, wherein the second housing has a plurality of cuts that form the elastic arm.

17. An electrical connector having a split electrical connector housing, the split electrical connector housing comprising:

a first housing with a plurality of contact receiving compartments, the first housing having a projection extending from an outer surface thereof;

a second housing independent from the first housing, the second housing having a first housing receiving opening that receives the first housing;

an elastic arm formed on an outer surface of the second housing, the elastic arm having a protrusion that extends into the first housing receiving opening and engages the projection as the first housing is received in the first housing receiving opening, the elastic arm being biased upward by the projection to change a contour of the outer surface of the second housing when the first housing is partially received in the second housing;

the projection having an inclined front surface and an inclined top surface for facilitating movement of the protrusion there over; and the protrusion having an inclined rear surface that has a greater slope than the inclined front surface of the projection.

18. The electrical connector of claim 17, wherein the contour of the outer surface of the second housing is restored when the first housing is fully received in the second housing.

19. The electrical connector of claim 17, wherein the protrusion locks the first housing in the second housing when the first housing is fully received therein.

20. The electrical connector of claim 19, wherein the protrusion engages the projection to lock the first housing in the second housing.

21. The electrical connector of claim 17, wherein the second housing has a section separate from the first housing receiving opening provided with a plurality of contact receiving compartments.

22. The electrical connector of claim 17, wherein the second housing has a plurality of cuts that form the elastic arm.

* * * * *